US006077820A

United States Patent [19]

Dhanuka et al.

[11] Patent Number: 6,077,820

[45] **Date of Patent: *Jun. 20, 2000**

[54] PROCESS FOR PREPARING A GRANULAR DETERGENT

[75] Inventors: Vinodkumar Ramniranjan Dhanuka; Fakhruddin Esmail Pacha, both of Mumbai, India

[73] Assignee: Lever Brothers Company Division of Conopco, Inc., New York, N.Y.

[ * ] Notice: This patent is subject to a terminal disclaimer.

[21] Appl. No.: 09/262,565

[22] Filed: Mar. 4, 1999

Related U.S. Application Data

[63] Continuation of application No. 08/766,408, Dec. 12, 1996, Pat. No. 5,929,021.

[30] Foreign Application Priority Data

Dec. 20, 1995 [GB] United Kingdom ..... 9526097

[51] Int. Cl.[7] ..... C11D 11/00

[52] U.S. Cl. ..... 510/444; 510/351; 510/356; 510/357; 510/495; 510/509; 23/313 R; 23/313 FB; 264/117

[58] Field of Search ..... 510/444, 351, 510/356, 357, 509, 495; 264/117; 23/313 R, 313 FB

[56] References Cited

U.S. PATENT DOCUMENTS

| | | | |
|---|---|---|---|
| 4,828,721 | 5/1989 | Bollier et al. | 252/8.7 |
| 4,846,409 | 7/1989 | Kaspar et al. | 241/21 |
| 4,919,847 | 4/1990 | Barletta et al. | 252/288 |
| 5,164,108 | 11/1992 | Appel et al. | 510/444 |
| 5,366,652 | 11/1994 | Capeci et al. | 510/444 |
| 5,516,449 | 5/1996 | Agar et al. | 252/102 |
| 5,520,838 | 5/1996 | Baeck et al. | 252/174.12 |
| 5,576,285 | 11/1996 | France et al. | 510/444 |
| 5,665,691 | 9/1997 | France et al. | 510/444 |
| 5,736,501 | 4/1998 | Yamashita et al. | 510/444 |
| 5,739,097 | 4/1998 | Bauer et al. | 510/446 |
| 5,929,021 | 7/1999 | Dhanuka et al. | 510/444 |

FOREIGN PATENT DOCUMENTS

| | | |
|---|---|---|
| 119 746 | 9/1984 | European Pat. Off. . |
| 158 419 | 10/1985 | European Pat. Off. . |
| 264 049 | 4/1988 | European Pat. Off. . |
| 352 135 | 1/1990 | European Pat. Off. . |
| 0353976 | 2/1990 | European Pat. Off. . |
| 367 339 | 5/1990 | European Pat. Off. . |
| 0402112 | 12/1990 | European Pat. Off. . |
| 544 365 | 6/1993 | European Pat. Off. . |
| 0643129 | 3/1995 | European Pat. Off. . |
| 140987 | 4/1980 | German Dem. Rep. . |
| 166307 | 4/1990 | India . |
| 60 072 999 | 4/1985 | Japan . |
| 2 166 452 | 5/1986 | United Kingdom . |
| 93/21297 | 10/1993 | WIPO . |
| 93/23523 | 11/1993 | WIPO . |
| 96/04359 | 2/1996 | WIPO . |
| 97/22685 | 6/1997 | WIPO . |
| 97/28246 | 8/1997 | WIPO . |
| 98/14549 | 4/1998 | WIPO . |
| 98/14550 | 4/1998 | WIPO . |
| 98/14551 | 4/1998 | WIPO . |
| 98/14552 | 4/1998 | WIPO . |
| 98/14553 | 4/1998 | WIPO . |
| 98/14554 | 4/1998 | WIPO . |
| 98/14555 | 4/1998 | WIPO . |
| 98/14556 | 4/1998 | WIPO . |
| 98/14557 | 4/1998 | WIPO . |
| 98/14558 | 4/1998 | WIPO . |
| 98/58046 | 12/1998 | WIPO . |
| 98/58047 | 12/1998 | WIPO . |
| 98/58048 | 12/1998 | WIPO . |
| 99/00475 | 1/1999 | WIPO . |
| 99/03964 | 1/1999 | WIPO . |
| 99/03966 | 1/1999 | WIPO . |
| 99/03967 | 1/1999 | WIPO . |

*Primary Examiner*—Lorna M. Douyon
*Attorney, Agent, or Firm*—Rimma Mitelman

[57] ABSTRACT

A process for producing a detergent powder or a composition therefore involving partial granulation in a high or low shear granulator followed by granulation in a very low shear mixer, for example a fluid bed is disclosed. The process allows powders to be produced over a wide range of bulk densities without the use of a spray-drying step.

9 Claims, No Drawings

PROCESS FOR PREPARING A GRANULAR DETERGENT

This is a continuation of Ser. No. 08/766,408 filed Dec. 12, 1996, now U.S. Pat. No. 5,929,021.

BACKGROUND OF THE INVENTION

The present invention relates to a process for the preparation of granular detergent or cleaning compositions with a wide range of bulk densities of between about 300–1300 g/l. More particularly the process of the invention makes use of a novel combination of high or low speed mixer/granulator in combination with a very low shear granulator. There has been considerable interest in detergent industry to develop processes for the production of granulated detergent powders exhibiting specific bulk densities. In the detergent industry powders exhibiting different bulk densities are available and specific processes are used to target specific ranges of bulk densities.

There are a number of single step processes which produce powders within a very narrow range of bulk densities. Two stage granulation processes for production of powders of bulk densities greater than 600 g/l are also known.

JP 60 072 999A (Kao) and GB 2 166 452B (Kao) disclose processes in which detergent sulphonic acid, sodium carbonate and water are mixed in a strongly shearing apparatus; the solid mass obtained is cooled to 40° C. or below and pulverized; and the fine powder thus obtained is granulated.

There has also been considerable recent interest in the use of high-speed mixer/granulators in the preparation of high-bulk-density detergent powders. For example, EP 158 419B (Hashimura) discloses a process in which nonionic surfactant and soda ash are mixed and granulated in a reactor having horizontal and vertical blades rotating at different speeds, to give a detergent powder built with sodium carbonate and containing a high level of nonionic surfactant.

Patent Application No. W093/23523 describes a process for the continuous production of granular detergent and/or cleaning compositions exhibiting bulk densities between 600 and 1100 g/l by a two-stage granulation in two mixer/granulators arranged in series where 40–100% of the solid and liquid ingredients based on the total weight of solid and liquid ingredients used is pregranulated in a first low speed mixer granulator and the granulate from the first stage is mixed with the remaining solid and/or liquid ingredients in a second high speed mixer granulator and converted into a granulate where the content of the granules having diameters greater than 2 mm is less that 25 wt. percent. The low speed granulator used in the first granulation stage provided peripheral velocities of the mixing elements between 2 m/s and 7 m/s. Preferred low speed mixer granulators are, e.g., the plough mixers made by Lodige, Germany and the intensive mixer made by IMAPVC, Germany. The high speed mixer granulator provides for a peripheral velocity of the mixing elements of 8 m/s to 35 m/s. A suitable high speed mixer granulator is, for example, that made by Schugi, The Netherlands.

Indian Patent No. 170497 describes a process for preparing a high bulk density granular detergent composition with bulk density of at least 650 g/l which comprises treating a particulate starting material in a first step in a high speed mixer/densifier, the mean residence time being about 5–30 seconds and in a second step in a moderate-speed granulator/densifier whereby it is brought into or maintained in a deformable stage, the mean residence time being 1–10 minutes, and a final step in a drying and/or cooling apparatus. Preferably, the particle starting material is already brought into and/or maintained in a deformable stage in the first step. An example of a suitable high speed mixer/densifier which may be used in this process is Lodige CB30 recycler. Other examples of suitable high speed mixers/densifiers are, for instance, Schugi® granulator or a Draise® K-TTP80. An example of a suitable moderate speed granulator/densifier which may be used in this process is a Lodige® KM300 mixer also referred to as a plough share mixer. Another suitable machine is, for example, Draise® K-T160.

Our copending application no. 92203563.9 (EP 6544,365) describes a detergent composition and a continuous process of producing detergent powders having bulk density of, for example, 600 g/l and above. This invention comprises treating a particulate starting material in a high speed mixer/densifier characterised in that 0.1–50% by weight as calculated on the granular detergent surfactant of liquid surfactant composition is mixed with the starting material during the treating process. For obtaining a very high bulk density powder, the detergent powder obtained by the process of the invention may be further treated in a second step in a moderate speed granulator/densifier whereby it is brought into or maintained in a deformable state, the mean residence time being 1–10 minutes and thereafter in a third step in drying/cooling apparatus for example as described in EP-A-367, 339.

Thus, high bulk density powders have either been produced by a single step granulation or by a suitable combination of a low speed mixer granulator in combination with a high speed mixer granulator or a high speed mixer granulator combined with a low speed mixer granulator. The low speed mixer granulators generally operate with tip speeds in the range 2–7 m/s and the high speed granulators operate with tip speeds in the range 8–35 m/s.

It is an object of the present invention to provide a process for preparing granular detergent or cleaning compositions in which the bulk density of the compositions may be selected as desired between 300–1300 g/l.

SUMMARY OF THE INVENTION

We have found that granular detergents or cleaning compositions having bulk densities between 300–1300 g/l may be produced by effecting partial granulation in a high or low speed mixer granulator optionally with simultaneous heating and/or drying and/or cooling followed by completion of granulation under very low shear optionally with drying or cooling. The desired bulk density of a granular composition may be obtained by appropriately regulating the granulation steps in the two different granulation stages.

Thus the present invention relates to a process for preparing granular detergents or cleaning compositions having bulk densities between 300–1300 g/l comprising mixing a particulate starting material in a low or high speed mixer/granulator;

adding a liquid binder and subjecting the mixture to partial granulation in the low or high speed mixer/granulator;

transferring the partially granulated mixture to a very low shear granulator;

adding further liquid binder to the mixture for a time sufficient to complete granulation and to thereby obtain a granular powder composition of desired bulk density.

DESCRIPTION OF THE PREFERRED EMBEDMENTS

Preferably, the process according to the invention comprises i) placing all the particulate starting materials including a builder and an alkaline inorganic material and optionally flow aids in a low or high speed mixer/granulator;

ii) mixing the particulate starting materials to obtain a substantially uniform particulate mix;

iii) adding a predetermined quantity of liquid binder to effect simultaneous granulation of the particulate mix, to provide a partly granulated powdered mix;

iv) introducing said partly granulated powdered mix into a very low shear granulator, and;

v) adding the balance quantity of liquid binder to complete the granulation process over a sufficient time to obtain the required properties of the powder.

A preferred bulk density range for the final product is from 350 to 1000 g/l.

The quantities of liquid binder added in steps (iii) and (v) depends upon the final product density desired, as explained below.

The extent of granulation in the low or high speed mixer/granulation and the very low shear granulator can be controlled typically as below depending on the final product density desired.

If the powder bulk density is at the low end, i.e. 300–650 g/l, more preferably from 350–650 g/l, then preferably from 5% to 75% by weight of the total liquid binder should be added in the low/high speed mixer. Then, the remaining 95% to 25% of the total liquid binder should be added in the very low shear granulator.

If, on the other hand, the bulk density is at the higher end, i.e. 550–1300 g/l, more preferably from 550–1000 g/l, then preferably from 75% to 95% by weight of the total liquid binder should be added in the low/high speed mixer. Then, the remaining 25% to 5% of the total liquid binder should be added in the very low shear granulator.

Obviously, there is some overlap in the aforementioned ranges. However, the low end range could be applicable to 300 (or 350) to 550 g/l bulk density and/or the higher end to 650 to 1300 (or 1000) g/l.

The process of the invention may be carried out in batch or continuous mode of operation.

The choice of the high or low speed mixer/granulator is important. Suitable examples of high speed mixers of the present invention include the Lodige® CB machine and suitable examples of moderate speed mixers include the Lodige® KM machine. Other suitable equipment include the Drais® T160 series manufactured by Draise WerkeGmbH, Germany; the Littleford mixer with internal chopping blades, and the turbine type miller mixer having several blades on an axis of rotation. A low or high speed mixer granulator has a stirring action and/or a cutting action which may be operated independently of one another. Preferred types of low or high speed mixer granulator are mixers of the Fukae® FS-G series;

Diosna® V series ex Dierks & Sohne, Germany; Pharma Matrix® ex T. K. Fielder Ltd;, England. Other mixers suitable for use in the process of the invention are the Fuji® VG-C series ex Fuji Sangyo Co., Japan; the Roto® ex Zanchetta & Co. srl, Italy and Schugi® Flexomix granulator.

Yet another mixer found to be suitable for use in the process of the invention is the Lodige (Trade Mark) FM series (ploughshare mixers) batch mixer ex Morton Machine Co. Ltd., Scotland or a Farberg mixer.

The typical tip velocity of these mixers is in the range of 1–40 m/s.

Preferred very low shear granulators or mixer/granulators are fluid bed and rotating bowl mixers. A typical fluidised bed is operated at a superficial air velocity of about 0.1–1.5 m/s, either under positive or negative pressure and an inlet air temperature ranging from −10° C. or 5° C. to 80° C. or even up to 200° C.

According to the present invention a final granulometry may be defined, for example that percentage of particles falling within a given size range. The mixture of particulate starting material and liquid binder is then granulated in the high/low speed mixer/granulator to a granulometry different to the final granulometry, for example having a greater quantity of fine particles. The partially granulated mixture is then granulated to the final granulometry in the very low shear granulator. Densification of the material may occur simultaneously with granulation in the high/low speed mixer/granulator, or very low shear granulator. Granular detergent compositions according to the present invention should preferably have less than 5% by weight of granules less than 180 microns in diameter.

The process of the invention is highly flexible in terms of the selection of actives, their levels, the formulations.

Preferably, the products of the process of the invention contain anionic surfactant.

The process of the present invention is especially flexible concerning the particulate starting materials. The starting material is suitably chosen from the compounds commonly used in detergent formulations such as builders, alkaline salts, detergent active materials and mixtures thereof. Compositions containing phosphate and/or zeolite are preferably used as starting materials.

The process may with advantage be used to prepare detergent compositions containing from 5 to 50 wt %, especially from 15 to 35 wt %, of anionic surfactant, this anionic surfactant being derived wholly or in part from an in situ neutralisation reaction in steps (iii) and/or (v).

The liquid binder may comprise, water, anionic surfactant, nonionic surfactant or mixtures thereof.

The process of the invention is of special interest for the production of detergent powders of components containing relatively high levels of anionic surfactant, for example, from 18 to 35 wt %, more especially 15 to 30 wt %, but it is equally useful for the preparation of powders containing lower levels of anionic surfactant for example up to 20 wt % and including the particulate starting material which very preferably contains an alkaline inorganic material, preferably an alkaline salt, in particular an alkaline carbonate, bicarbonate or mixture thereof.

Preferably, the unneutralised acid is added in a substantially stoichiometric amount. It is, however, possible that the alkaline material could be in excess. For example, the excess alkaline material may act as a builder.

In order to produce anionic surfactant in-situ the particulate starting material preferably contains a solid alkaline material, for example sodium carbonate and the liquid binder preferably contains an acid corresponding to the anionic surfactant to be produced, for example LAS acid.

The anionic surfactant prepared at least in part by in situ neutralisation may, for example, be selected from linear alkylbenzene sulphonates, alpha-olefin sulphonates, internal olefin sulphonates, fatty acid ester sulphonates and combinations thereof. The process of the invention is especially useful for producing compositions containing alkylbenzene sulphonates, by in situ neutralisation of the corresponding alkylbenzene sulphonic acid.

The present inventors have discovered that the final bulk density of the product of the present process may be altered by varying the percentage of unneutralised acid added in the high/low speed mixer/granulator and in the very low shear granulator. For a low bulk density, the greater part of the unneutralised acid should be added in the very low shear granulator. For example, if the powder bulk density is at the low end, i.e. 300–650 g/l, more preferably from 350–650 g/l, then preferably from 5% to 75% by weight of the total unneutralized acid should be added in the low/high speed mixer. Then, the remaining 95% to 25% of the total unneutralized acid should be added in the very low shear granulator.

If, on the other hand, the bulk density is at the higher end, i.e. 550–1300 g/l, more preferably from 550–1000 g/l, then preferably from 75% to 95% by weight of the total unneutralized acid should be added in the low/high speed mixer. Then, the remaining 25% to 5% of the total unneutralized acid should be added in the very low shear granulator.

Obviously, there is some overlap in the aforementioned ranges. However, the low end range could be applicable to 300 (or 350) to 550 g/l bulk density and/or the higher end to 650 to 1300 (or 1000) g/l.

Other anionic surfactants that may be present in compositions prepared by the process of the invention include primary and secondary alkyl sulphates, alkyl ether sulphates, and dialkyl sulphosuccinates and mixtures thereof. Anionic surfactants are of course well known and the skilled reader will be able to add to this list by reference to the standard textbooks on this subject.

If an especially high content of anionic surfactant in the final product is desired, additional anionic surfactant, in salt form rather than in acid precursor form, may be added after granulation. Solid particulate anionic surfactant may also be added at an earlier stage in the process. Thus, the process of the invention represents a versatile route for incorporating high levels of anionic surfactant in powders.

As previously indicated, nonionic surfactants and/or high active mixtures may also be present. These too are well known to those skilled in the art, and include primary and secondary alcohol ethoxylates. Neutralised anionic surfactant may be mixed with non-ionics surfactants.

Other types of non-soap surfactant, for example, cationic, zwitterionic, amphoteric or semipolar surfactants, may also be present, if desired. Many suitable detergent-active compounds are available and are fully described in the literature, for example, in "Surface-Active Agents and Detergents", Volumes I and II, by Schwarts, Perry and Berch.

If desired, soap may also be present, to provide foam control and additional detergency and builder properties.

The detergency builder present in the starting material may be any conventional builder used for removing the free calcium ions in wash liquor and for other known benefits associated with builders. Examples of suitable builders include tripolyphosphate salts, for example of sodium, zeolite, citrates, soda ash, layered silicates etc. The amount of builder material incorporated as part of the starting material is such that the final builder content in the composition is between 5 to 60% and preferably between 10 to 35% by weight.

Typically, detergent compositions produced by the process of the invention may comprise from 0 to 40 wt % of anionic surfactant, from 0 to 40 wt % of nonionic surfactant and from 0 to 5 wt % of fatty acid soap.

The detergent compositions of the present invention may be complete detergent compositions in themselves, or they may be used as detergent components which may be mixed with other conventional materials, for example bleaches and enzymes to produce a fully formulated product.

The detergent composition may optionally comprise of one or more flow aids which may be selected from dicamol, crystalline or amorphous alkali silicates, calcites, diatamaceous earth, precipitated silica, magnesium sulphate, precipitated calcium carbonate, or mixtures thereof etc. The flow aid may be present in a quantity of 0.1–15 wt %.

Detergent compositions that may be prepared by the process of the invention may contain appropriate amounts of other conventional ingredients, for example filler (for example, an inorganic salt such as NaCl), bleaches, enzymes, lather boosters or lather controllers as appropriate, antiredeposition and anti-incrustation agents, perfumes, dyes and fluorescers. These may be incorporated in the product at any suitable stage, and the skilled detergent formulator will have no difficulty in deciding which ingredients are suitable for admixture in the low or high-shear mixer/granulator, or very low shear granulator.

The compositions may contain a total of from 10 to 70 wt % of water-soluble crystalline inorganic salts, which may comprise, for example, sodium carbonate, sodium sulphate, sodium tripoly-phosphate, sodium ortho-or pyrophosphate, or sodium meta- or orthosilicate. Especially preferred compositions contain from 10 to 50 wt %, of soluble crystalline inorganic salts.

Where the very low shear granulator comprises a fluidised bed, very fine particles will automatically be elutriated.

The resulting fine powder removed by the air stream from the fluidised bed may be returned to the very low shear granulator or to the high/low speed mixer/granulator.

The invention will now be illustrated by way of example with reference to the following Examples.

EXAMPLE I

11 Kgs of Sodium Tripolyphosphate, 15 Kgs of Soda Ash and 13 Kgs of fine salt were charged into a ploughshare mixer. The mass was mixed for 30 seconds. 1 Kg of sulphonic acid was incorporated into the ploughshare mixer for a period of over 2 to 5 minutes while continuing to run the main agitator and chopper. Thereafter 1 Kg of precipitated silica was added to the mixer and mixed for 30 seconds.

The partly granulated powder was transferred to a fluid bed. The partly granulated powder was fluidised by supply of air.

9 Kg. of sulphonic acid was sprayed onto the mass using a twin fluid atomiser to complete granulation. The powder was discharged and sieved through a 10 mesh sieve.

The bulk density was 480 g/l.

EXAMPLES II–VI

The procedure of example I was repeated by altering the amount of addition of the sulphonic acid in the two stages. The bulk densities of the final powder were measured and these are listed in Table I.

TABLE I

| EXAMPLES | LAS Addition (Kg) In Ploughshare | LAS Addition (Kg) In Fluid Bed | Product BD (g/l) |
|---|---|---|---|
| I | 1 | 9 | 480 |
| II | 2.5 | 7.5 | 500 |
| III | 5 | 5 | 530 |
| IV | 7.5 | 2.5 | 550 |
| V | 8.5 | 1.5 | 600 |
| VI | 9 | 1 | 750 |

EXAMPLE VII

12 Kg of Sodium tripolyphosphate, 5 Kg of zeolite and 20 Kg of Soda ash were mixed in a ploughshare mixer for 30 Sec. 2 Kg of Sulphonic acid was sprayed over one minute while the mixture was agitated and chopped. The entire mass was transferred to a fluid bed and fluidised by supply of air and 12 Kg Sulphonic acid was sprayed using a twin fluid atomiser. The powder was discharged and sieved through a 10 mesh sieve. The bulk density of this powder was 400 g/l.

EXAMPLE VIII

12 Kg of Sodium sulphate, 10 Kg of sodium carbonate, 13 Kg of zeolite was charged into a ploughshare mixer. The mass was mixed for 30 seconds. 1.5 Kg of molten stearic acid followed by 2.5 Kg of Non-ionics ($C_{12}EO_5$) and 2.5 Kg sulphonic acid were added into the ploughshare mixer over 5 minutes while continuing to run the main agitator and chopper. 1.75 Kg of silicate solution (40% concentration) was also added to the mixer and mixed for 2 minutes.

The partly granulated powder was transferred to a fluid bed and fluidised by supply of air. 0.5 Kg of sulphonic acid was sprayed on to the mass using a twin fluid atomiser to complete granulation. The powder was discharged and sieved through a 10 mesh sieve. The bulk density was 900 g/l.

EXAMPLE IX 22.5 kg of sodium chloride, 16 kg of sodium carbonate, 1.5 kg of precipitated calcium carbonate and 1 kg of Dicamol was charged into a ploughshare mixer. The mass was mixed for 30 seconds. 2.5 kg of sulphonic acid was sprayed over one minute while the mixture was agitated and chopped. The entire mass was transferred to a fluid bed and fluidised by supply of air and 6.5 kg sulphonic acid was sprayed using a twin fluid atomiser. The powder was discharged and sieved through a 10 mesh sieve. The bulk density of this powder was 550 g/l.

EXAMPLE X 22.5 kg of sodium sulphate, 13.7 kg of sodium carbonate, 1 kg of STPP and 2 kg of zeolite was charged into a ploughshare mixer. The mass was mixed for 30 seconds. 2.5 kg of sulphonic acid was sprayed over one minute while the mixture was agitated and chopped. The entire mass was transferred to a fluid bed and fluidised by supply of air and 5.3 kg sulphonic acid was sprayed using a twin fluid atomiser. The powder was discharged and sieved through a 10 mesh sieve. The bulk density of this powder was 650 g/l.

What is claimed is:

1. A process for producing a granular detergent or cleaning composition of bulk density in the region of 350–650 g/l comprising the steps of:

a) mixing a particulate starting material and 5 to 75% by weight of the total amount of liquid binder in a low/high speed mixer/granulator, the liquid binder comprising:

(i) a nonionic surfactant, and (ii) an anionic surfactant and/or an acid precursor of an anionic surfactant;

and subjecting the resulting mixture to partial granulation, to produce a partially granulated mixture; and b) transferring the partially granulated mixture to a fluid bed or rotating bowl mixer/granulator, adding the remaining from 95 to 25% by weight of the total amount of liquid binder and mixing for a time sufficient to complete granulation to obtain the granular detergent or cleaning composition of desired bulk density.

2. A process according to claim 1, in which the particulate starting material comprises a detergent builder.

3. a process according to claim 1, in which the particulate starting material comprises alkaline inorganic material as a neutralizing agent.

4. A process according to claim 3, wherein the neutralizing agent is present in excess of stoichiometric amount.

5. A process for producing a granular detergent or cleaning composition of bulk density in the region of 550–1000 g/l comprising the steps of:

a) mixing a particulate starting material and 75 to 95% by weight of the total amount of liquid binder in a low/high speed mixer/granulator; the liquid binder comprising:

(i) a nonionic surfactant, and (ii) an anionic surfactant and/or an acid precursor of an anionic surfactant; and subjecting the resulting mixture to partial granulation, to produce a partially granulated mixture; and b) transferring the partially granulated mixture to a fluid bed or rotating bowl mixer/granulator, adding the remaining from 25 to 5% by weight of the total amount of liquid binder and mixing for a time sufficient to complete granulation to obtain the granular detergent or cleaning composition desired bulk density.

6. A process according to claim 5 in which the particulate starting material comprises a detergent builder.

7. A process according to claim 5 in which the particulate starting material comprises alkaline inorganic material as a neutralizing agent.

8. A process according to claim 7 wherein the neutralizing agent is present in excess of stoichiometric amount.

9. A process according to claim 7 in which the alkaline inorganic material is an alkali metal carbonate.

* * * * *